US010340636B1

(12) United States Patent
Twenge

(10) Patent No.: US 10,340,636 B1
(45) Date of Patent: Jul. 2, 2019

(54) ELECTRIC PLUG LOCKERS

(71) Applicant: Jacob Twenge, Newberg, OR (US)

(72) Inventor: Jacob Twenge, Newberg, OR (US)

( * ) Notice: Subject to any disclaimer, the term of this patent is extended or adjusted under 35 U.S.C. 154(b) by 0 days.

(21) Appl. No.: 15/918,790

(22) Filed: Mar. 12, 2018

(51) Int. Cl.
*H01R 13/639* (2006.01)
*A44B 11/24* (2006.01)
*A44B 11/28* (2006.01)
*A44B 11/25* (2006.01)

(52) U.S. Cl.
CPC ..... *H01R 13/6392* (2013.01); *A44B 11/24* (2013.01); *A44B 11/25* (2013.01); *A44B 11/28* (2013.01)

(58) Field of Classification Search
CPC ... H01R 13/639; H01R 13/6392; A44B 11/24; A44B 11/25; A44B 11/26
USPC ..... 439/369
See application file for complete search history.

(56) References Cited

U.S. PATENT DOCUMENTS 3,475,716 A * 10/1969 Laig ..... H01R 13/6392 439/369
3,999,828 A * 12/1976 Howell ..... H01R 13/6392 439/369
5,306,176 A * 4/1994 Coffey ..... H01R 13/6392 439/367
5,443,397 A * 8/1995 Carl ..... H01R 13/6392 439/369
5,573,420 A * 11/1996 Grosswendt ..... H01R 13/6392 24/16 PB
6,080,004 A * 6/2000 Kovacik ..... H01R 13/6392 439/352
6,176,729 B1 * 1/2001 Myers ..... H01R 13/6392 24/16 PB
6,375,231 B1 * 4/2002 Picha ..... A61M 39/1011 285/114
6,478,601 B2 * 11/2002 Oswald ..... H01R 13/6397 439/369
6,997,734 B1 * 2/2006 McQuirter ..... H01R 13/6392 439/369
7,004,785 B2 * 2/2006 Melton ..... H01R 13/6392 439/369
7,182,624 B1 * 2/2007 Miller ..... H01R 13/6392 439/369
7,186,130 B1 * 3/2007 Miller ..... H01R 13/639 439/369
9,097,370 B2 * 8/2015 Schnell ..... A61M 39/1011
9,276,359 B2 * 3/2016 Brown ..... H01R 13/6392
9,425,553 B2 * 8/2016 Brown ..... H01R 13/6392
9,463,564 B2 * 10/2016 Macauda ..... H01R 25/003
2015/0079833 A1 * 3/2015 Bunn ..... H01R 13/6392 439/352
2017/0170603 A1 * 6/2017 Bozikis ..... H01R 13/6392

* cited by examiner

*Primary Examiner* — Tulsidas C Patel
*Assistant Examiner* — Peter G Leigh
(74) *Attorney, Agent, or Firm* — Mohr Intellectual Property Law Solutions, PC

(57) ABSTRACT

Devices, systems, and methods of operating the same are described. The method may include attaching a first loop of a male connector to a first end of a first plug. The method may include attaching a second loop of a female connector to a second end of a second plug. The method may include connecting a first end of the first plug to the second end of the second plug. The method may include connecting a male fastener of the male connector to a female fastener of the female connector.

17 Claims, 6 Drawing Sheets

ELECTRIC PLUG LOCKERS

BACKGROUND

Electronic devices, such as tools, toys, electronics, and appliances, are often supplied with power from wall outlets. When an electrical cord of an electronic device is out of reach of a wall outlet, an extension cord is connected between the power outlet and the electronic device to extend the power from the power outlet to the cord of the electronic device. For example, a male end of the extension cord may be plugged into a female end of the power outlet and a female end of the extension cord may be plugged into a male end of the cord of the electronic device.

SUMMARY

A device, a system, or a method securing a first power cord to a second power cord. The method may include attaching a first loop of a male connector to a first end of a first plug. The method may include attaching a second loop of a female connector to a second end of a second plug. The method may include connecting a first end of the first plug to the second end of the second plug. The method may include connecting a male fastener of the male connector to a female fastener of the female connector.

BRIEF DESCRIPTION OF THE DRAWINGS

The present description will be understood more fully from the detailed description given below and from the accompanying drawings of various embodiments of the present embodiment, which is not to be taken to limit the present embodiment to the specific embodiments, but are for explanation and understanding.

DETAILED DESCRIPTION

Figure 1A:
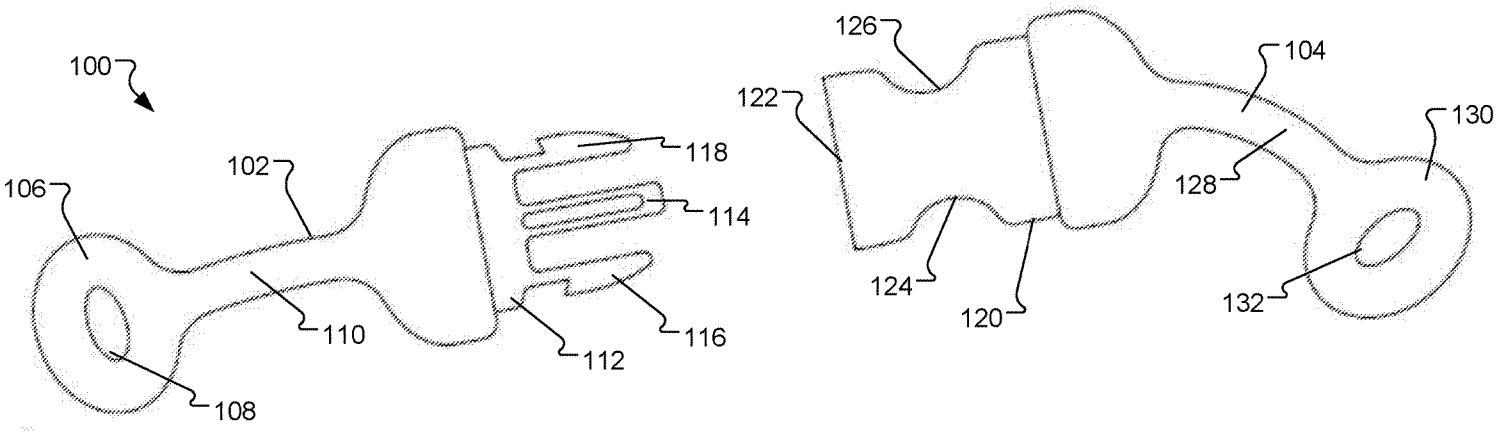
FIG. 1A shows an electric plug lock with a male connector and a female connector, according to an embodiment.

The disclosed electric plug lockers will become better understood through a review of the following detailed description in conjunction with the figures. The detailed description and figures provide merely examples of the various embodiments described herein. Those skilled in the art will understand that the disclosed examples may be varied, modified, and altered and not depart from the scope of the embodiments described herein. Many variations are contemplated for different applications and design considerations; however, for the sake of brevity, the contemplated variations may not be individually described in the following detailed description.

Throughout the following detailed description, examples of various electric plug lockers are provided. Related features in the examples may be identical, similar, or dissimilar in different examples. For the sake of brevity, related features will not be redundantly explained in multiple examples. Instead, the use of related feature names will cue the reader that the feature with a related feature name may be similar to the related feature in an example explained previously. Features specific to a given example will be described in that particular example. The reader is to understand that a given feature need not be the same or similar to the specific portrayal of a related feature in any given figure or example.

An electronic device is often connected to extensions cords to extend a range of a power cord of the electronic device to reach a power outlet and receive power. To connect the power cord of the electronic device to an extension cord, a male head of the power cord may be inserted into a female head at a first end of the extension cord. A male head at a second end of the extension cord may be connected to a female head of the power outlet. Once the extension cord has been connected to the power cord of the electronic device and the power outlet, the electronic device may receive power from the power outlet via the extension cord. When a single extension cord is not long enough to reach between the power outlet and the power cord, multiple extension cords may be connected together until an overall length of the multiple extension cords is long enough to reach between the power cord and the power outlet.

Conventionally, the connection between the female and male heads of the power cord and the extension cord or between multiple extension cords is a friction fit connection. Because the friction fit provides a minimal pull strength to disconnect the female and male head, the female and male head may often become spontaneously or unexpectedly disconnected. The spontaneous or unexpected disconnection may cause an inconvenience to a user and pose a safety hazard to the user and other individuals. The spontaneous or unexpected disconnection may be caused by the lack of sufficient frictional engagement between the male head and the female head, by inadvertent tension placed on the extension cords, or by a vibration of the power cord or the extension cord due to the operation of the electronic device. When the male head and the female head become partially separated, the male head may become exposed before the male head disconnects from the female head. The partially separated male head and female head may pose a safety hazard where an electrically live portion of the male head is exposed.

The embodiments described herein may address the above-noted deficiencies by providing an electric plug locker. The electric plug locker may be a device with a male connector that includes a male fastener and a first loop portion with an expandable first opening to fit over a head of a first plug. The device may also include a female connector with a female fastener and a second loop portion with an expandable second opening to fit over a head of a second plug. The female fastener may connect to the male fastener to secure the head of the first plug to the head of the second plug.

FIG. 1A shows an electric plug lock 100 with a male connector 102 and a female connector 104, according to an embodiment. The male connector 102 may include a loop portion 106 with an opening 108. The loop portion 106 may be adjustable to increase or decrease a size of the opening 108. For example, the loop portion 106 may be an elastic material that may be stretched to temporarily fit over a head of a first power cord and onto a portion of a cord attached to the head. Once the loop portion 106 is stretched over the head of the first power cord, the opening 108 of the loop portion 106 may decrease in size to approximately the size of the outer perimeter of the cord. The terms power cords and extension cords cord may be used interchangeably. A power cord or an extension cord may refer to an electrical cable that conducts electricity. The power cord or extension cord may be connected to a wall outlet, a power outlet, another power cord, another extension cord, an electronic device, a plug, a plug head, and so forth.

The loop portion 106 may be connected to a neck 110 of the male connector 102. The neck 110 may be a strip of material with a proximal end connected to the loop portion 106 and a distal end connected to a male fastener 112. The neck 110 may be a relatively long thin piece of material to connect the loop portion 106 to the male connector 102.

The female connector 104 may be connected to a distal end of a neck 128 of the female connector 104. The neck 128 may be a strip of material with a proximal end connected to a loop portion 130 and a distal end connected to the female fastener 120. The neck 128 may be a relatively long thin piece of material to connect the loop portion 130 to the female connector 104.

The loop portion 130 may be adjustable to increase or decrease a size of the opening 132. For example, the loop portion 130 may be an elastic material that may be stretched to temporarily fit over a head of a second power cord and onto a portion of a cord attached to the head. Once the loop portion 130 is stretched over the head of the second power cord, the opening 132 of the loop portion 130 may decrease in size to approximately the size of the outer perimeter or diameter of the cord.

The male fastener 112 may be a male portion of a buckle, a clip, a clasp, a belt connector, a hook, a harness, and so forth. The female fastener 120 may be a female portion of the buckle, the clip, the clasp, the belt connector, the hook, the harness, and so forth. The male fastener 112 may be inserted into a female fastener 120 to secure or lock the male fastener 112 to the female fastener 120, as discussed below. In one embodiment, the male fastener 112 may be a male clip with prongs to insert into the female fastener 120. For example, the male fastener 112 may include a center prong 114, a first outer prong 116, and a second outer prong 118. When the male fastener 112 is inserted into the female fastener 120, the first outer prong 116 and the second outer prong 118 may be pressed toward the center prong 114 as the male fastener 112 is inserted into a first opening 122 of the female fastener 120.

When the male fastener 122 has been fully inserted into the female fastener 120, the first outer prong 116 may partially extend through a second opening 124 in the female fastener 120 and the second outer prong 118 may partially extend through a third opening 126 in the female fastener 120. When the first outer prong 116 partially extends through a second opening 124 and the second outer prong 118 partially extends through a third opening 126, the male fastener 112 may be secured or locked to the female fastener 120. To release the male fastener 112 from the female fastener 120, the first outer prong 116 and the second outer prong 118 may be pressed toward the center prong 114 to remove the first outer prong 116 from the second opening 124 and the second outer prong 118 from the third opening 126, respectively.

In one embodiment, the openings 108 and/or 132 may have a diameter of approximately 6-7 millimeters (mm) in diameter. In another embodiment, an outer diameter of the loop portions 106 and/or 130 may be approximately 12-13 mm. In another embodiment, the necks 110 and/or 128 may be approximately 25-32 mm wide. In another embodiment, the male fastener 112 and/or the female fastener 120 may be approximately 19-20 mm wide. In another embodiment, the loop portions 106 and 130 and/or the necks 110 and 128 may be approximately 6-13 mm thick. The size and shape of the portions of the male connector 102 and/or the female connector 104 are not intended to be limiting. For example, the size, shape, and/or diameter of the openings 108 and 132 may vary based on a size of the heads of cords that the openings 108 and 132 are intended to be stretched over.

In one embodiment, the male connector 102 and/oe the female connector 104 may be a metal material or another conductive material. In another embodiment, the male connector 102 and/or the female connector 104 may be a metal material or a conductive material with a coating material, such as plastic or rubber material, to insulate the metal material or the other conductive material from conducting electricity.

In another embodiment, the male connector 102 and the female connector 104 may be an insulating material. The insulating material may not be electrically conductive. For example, the insulating material may be a rubber material, a plastic material, a polyurethane material, a fabric material, and so forth. The male connector 102 and the female connector 104 may be insulating material to protect a user from accidental electrical shock by a power cord. For example, a power cord of an electronic device may be connected to an extension cord that is plugged into a power outlet. When the male connector 102 is connected to a power cord and the female connector 104 is connected to the power outlet, power may be conducted from the power outlet, through the extension cord and the power cord to the electronic device. When the ends of the power cord and the extension cord become partially disconnected, power may continue to be conducted to the electronic device while a bare conductor, such as a prong of the power cord, may be exposed. The insulating material of the male connector 102 and the female connector 104 may aid in protecting a user from coming in contact with the bare conductor as the user reconnects or disconnects the power cord and the extension cord.

Figure 1B:
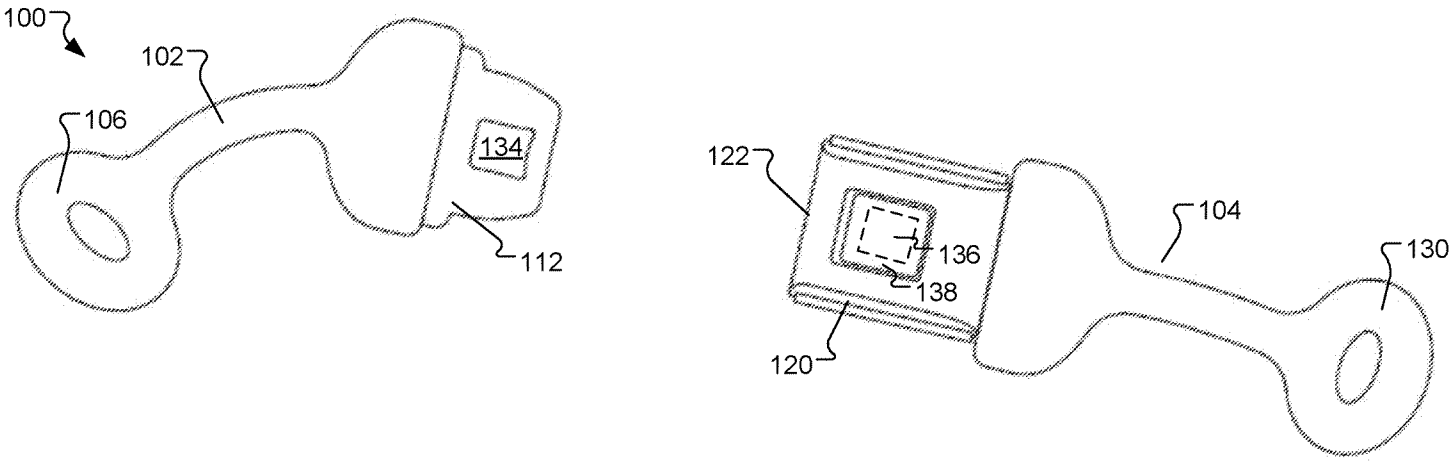
FIG. 1B shows the electric plug lock with the male connector where the male fastener is a male buckle connector and the female fastener is a female buckle connector, according to an embodiment.

FIG. 1B shows the electric plug lock 100 with the male connector 102 where the male fastener 112 is a male buckle connector and the female fastener 120 is a female buckle connector, according to an embodiment. Some of the features in FIG. 1B are the same or similar to some of the features in FIG. 1A as noted by the same reference numbers, unless expressly described otherwise. The male fastener 112 may include a hole 134 at approximately the center of the male fastener 112. The female fastener 120 may include the first opening 122, a latch 136, and a button 138. When the male fastener 112 is inserted into the first opening 122, the latch 136 may engage the hole 134 to extend through the hole 134 and secure or lock the male fastener 112 to the female fastener 120. To disengage the male fastener 112 from the female fastener 120, the button 138 may be pressed by an individual to disengage the latch 136 from the hole 134.

Figure 1C:
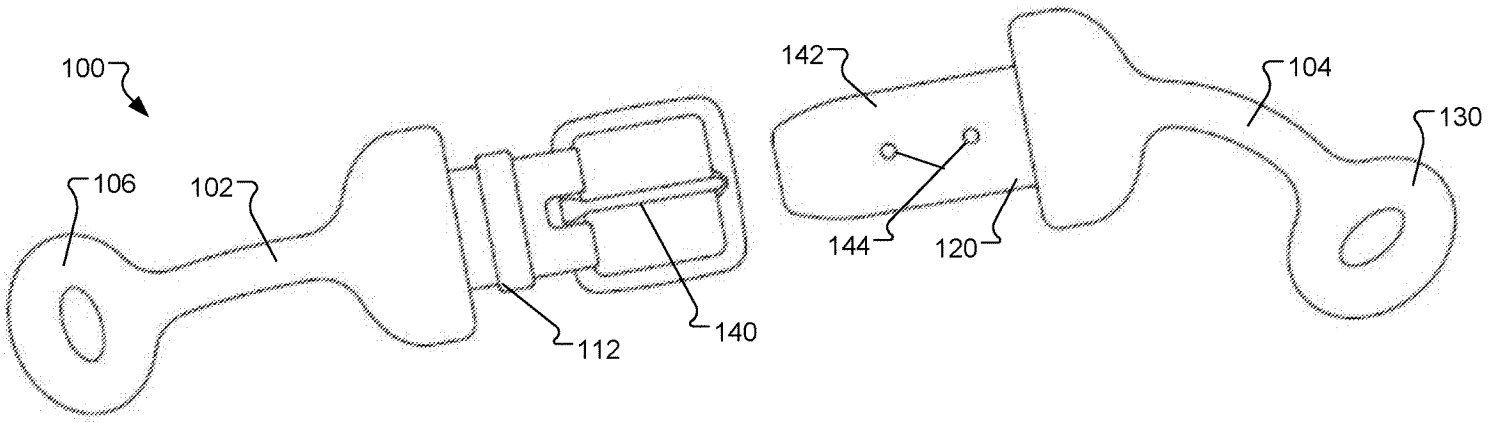
FIG. 1C shows the electric plug lock with the male connector that includes a prong and the female connector that includes a neck and one or more apertures, according to an embodiment.

FIG. 1C shows the electric plug lock 100 with the male connector 102 that includes a prong 140 and the female connector 104 that includes a neck 142 and one or more apertures 144, according to an embodiment. Some of the features in FIG. 1C are the same or similar to some of the features in FIGS. 1A and 1B as noted by the same reference numbers, unless expressly described otherwise. The male fastener 112 may include a prong 140 extending from the male fastener 112. The female fastener 120 may include the neck 142 with the one or more apertures 144. To connect the male fastener 112 to the female fastener 120, the prong 140 may be inserted into one of the apertures 144. In one example, the prong 140 may be inserted into different apertures to select how tightly the male fastener 112 and the female fastener 120 hold the ends of power cords together. In another example, the prong 140 may be inserted into different apertures 144 based on the size of the heads of the power cords.

Figure 1D:
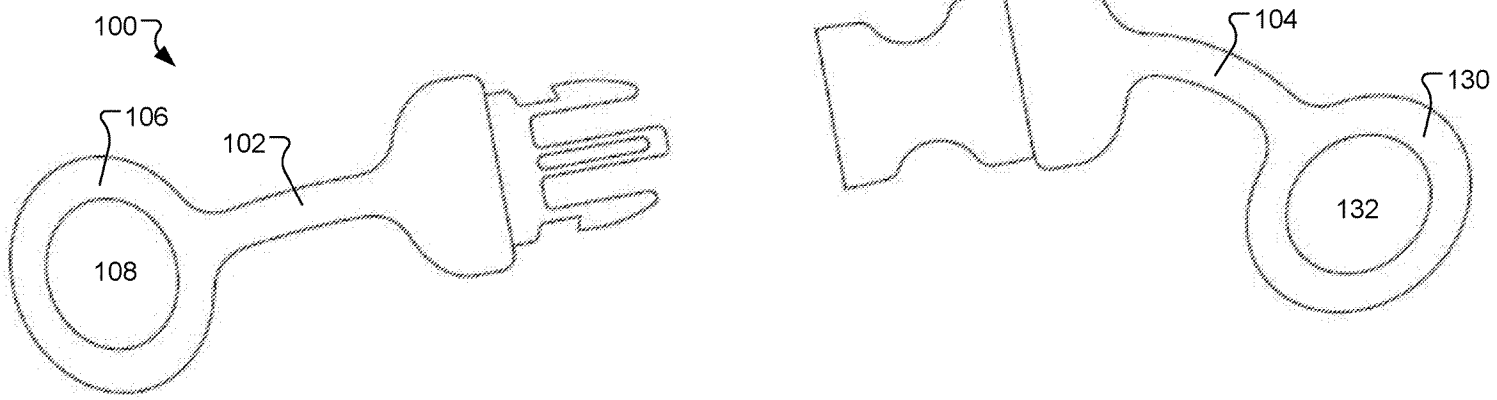
FIG. 1D shows the electric plug lock where the loop portion of the male connector is expanded and where the loop portion of the female connector is expanded, according to an embodiment.

FIG. 1D shows the electric plug lock 100 where the loop portion 106 of the male connector 102 is expanded and where the loop portion 130 of the female connector 104 is expanded, according to an embodiment. Some of the features in FIG. 1D are the same or similar to some of the features in FIGS. 1A-1C as noted by the same reference numbers, unless expressly described otherwise.

As discussed above, the loop portions 106 and 130 may be adjustable or expandable to increase or decrease a size of the openings 108 and 132, respectively. For example, the loop portion 106 may be stretched to temporarily increase a size of the opening 108 to fit over a head of a power cord and onto a portion of a cord attached to the head. Once the loop portion 106 is stretched over the head of the power cord, the opening 108 of the loop portion 106 may decrease in size to approximately the size of the outer perimeter or diameter of the cord. The loop portion 130 may similarly be stretched in increase a size of the opening 132 to fit over a head of another power cord to fit onto a cord of the power cord.

Figure 2A:
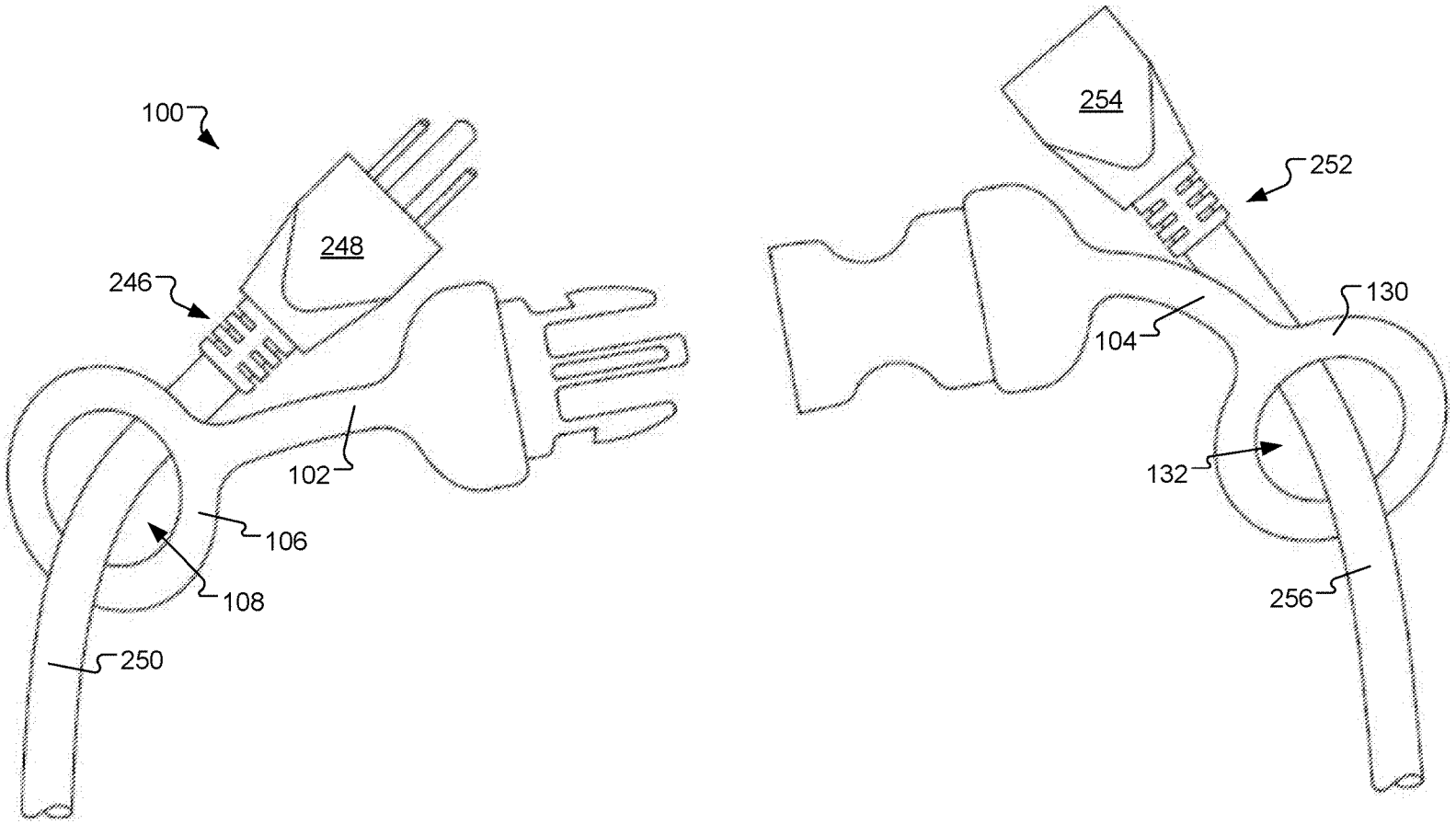
FIG. 2A shows the loop portion of the male connector connecting to a male connector of a first power cord and the loop portion of the female connector connecting to the female connector of a second power cord an embodiment.

FIG. 2A shows the loop portion 106 of the male connector 102 connecting to a male head 248 of a first power cord 246 and the opening 108 of the female connector 104 connecting to the female head 254 of a second power cord 252 an embodiment. Some of the features in FIG. 2A are the same or similar to some of the features in FIGS. 1A-1D as noted by the same reference numbers, unless expressly described otherwise.

A system for locking the first power cord 246 to the second power cord 252 may include the electric plug lock 100, the first power cord 246, and the second power cord 252. The loop portion 106 of the male connector 102 may be stretched over the head 248 of a first power cord 246. When the loop portion 106 is stretched over the head 248, the loop portion 106 may connect to the cord 250 of the first power cord 246 and circumscribe the cord 250. The loop portion 130 of the female connector 104 may be stretched over the head 254 of a second power cord 252. When the loop portion 130 is stretched over the head 254, the loop portion 130 may connect to the cord 256 of the second power cord 252 and circumscribe the cord 256. In one example, the head 248 may be a male head with one or more power prongs and the head 254 may be a female head with one or more cavities to receive the power prongs. In another example, the head 254 may be a male head with one or more power prongs and the head 248 may be a female head with one or more cavities to receive the power prongs.

In one embodiment, the male connector 102 may include indicia to indicate the male connector 102 is to connect to the head 248 of the first power cord 246 and the female connector 104 may include indicia to indicate the female connector 104 is to connect to the head 254 of the second power cord 252, or vise versa.

Figure 2B:
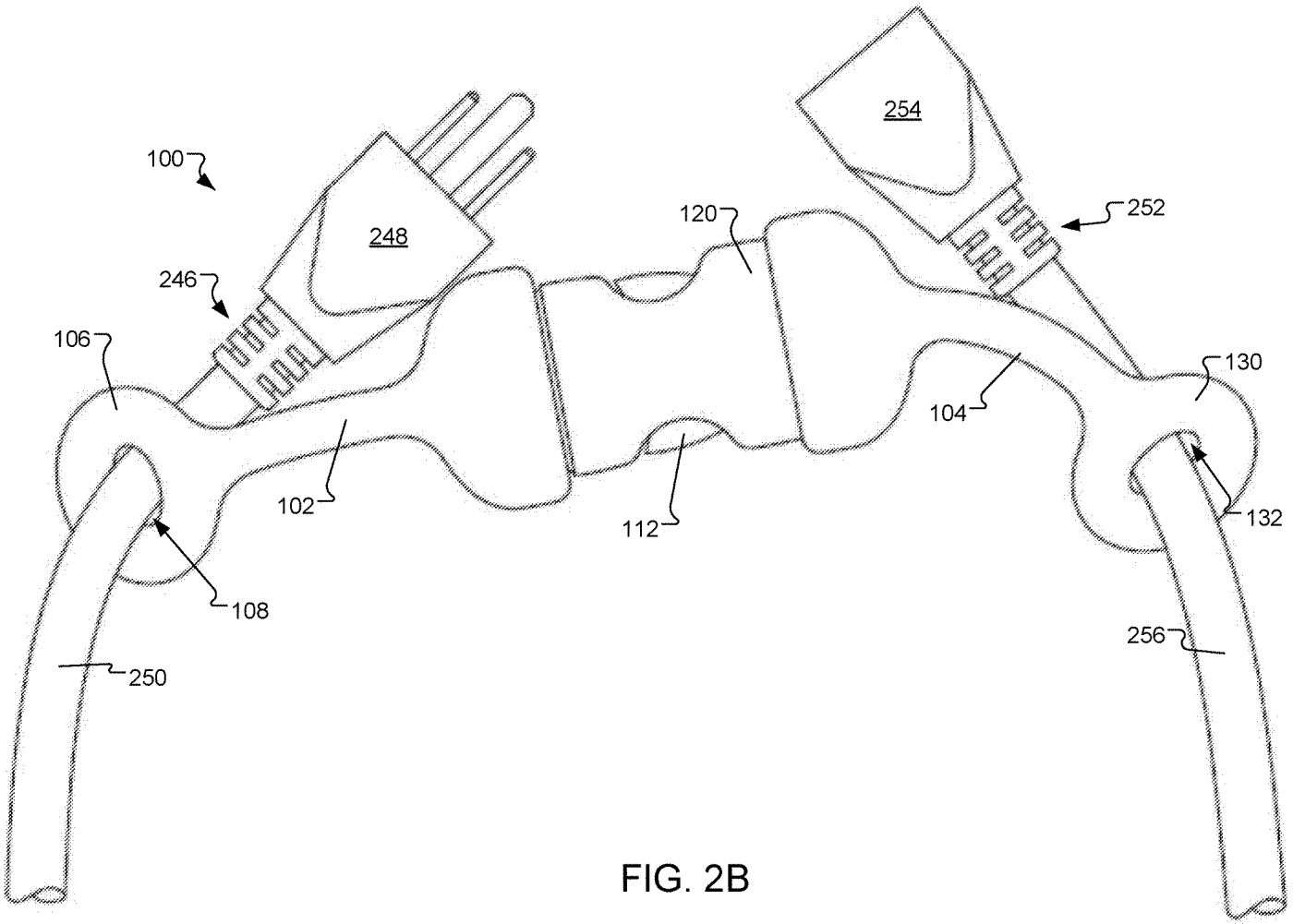
FIG. 2B shows the male connector of the electric plug lock being connected to the female connector of the electric plug lock, according to an embodiment.

FIG. 2B shows the male connector 102 of the electric plug lock 100 being connected to the female connector 104 of the electric plug lock 100, according to an embodiment. Some of the features in FIG. 2B are the same or similar to some of the features in FIGS. 1A-1D and 2A as noted by the same reference numbers, unless expressly described otherwise.

The loop portion 106 may be connected to the cord 250 of the first power cord 246 and circumscribe the cord 250. The loop portion 130 may be connected to the cord 256 of the second power cord 252 and circumscribe the cord 256. The head 248 of the first power cord 246 may be a male connector that includes one or more power prongs that may be inserted into one or more openings of the head 254 of the second power cord 252. The male connector 102 may be inserted into the female connector 104 to connect the male connector 102 to the female connector 104.

Figure 2C:
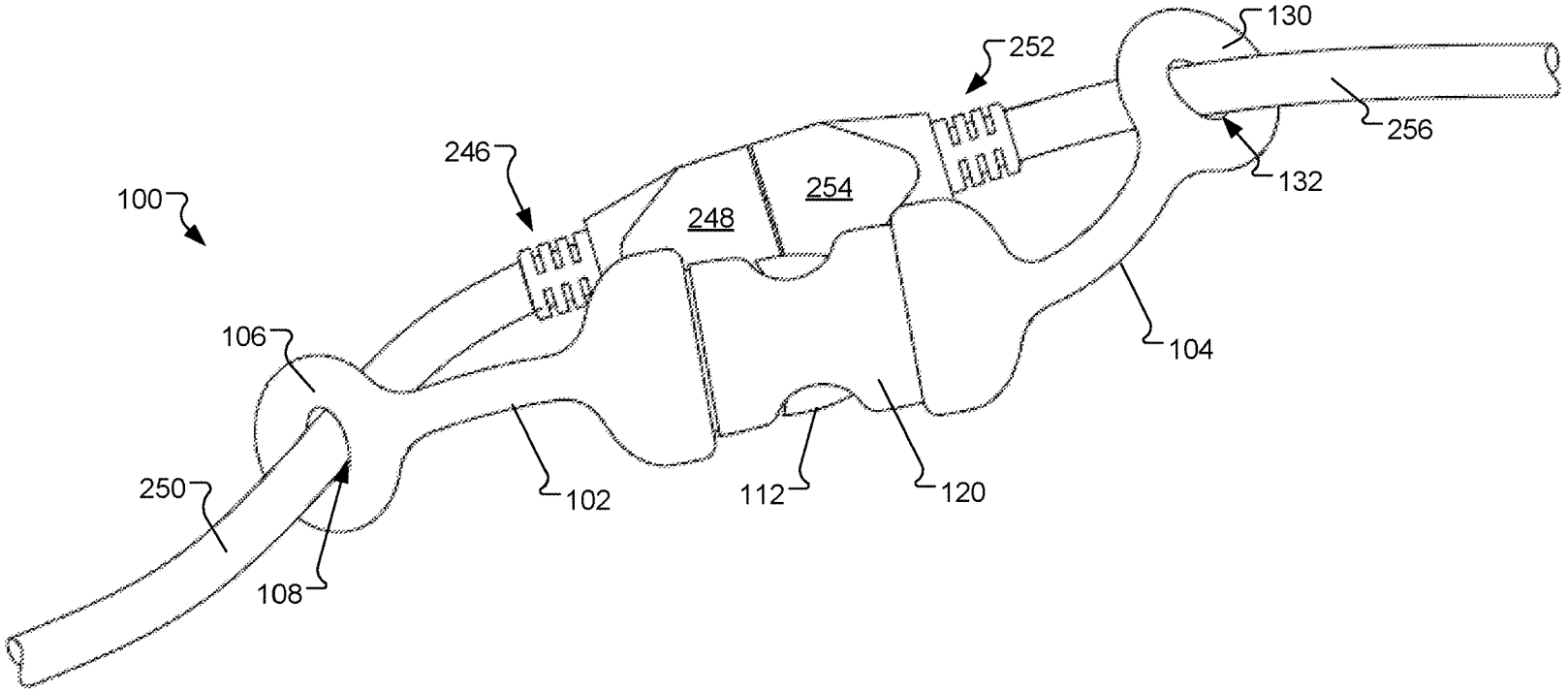
FIG. 2C shows the male connector of the electric plug lock connected to the female connector of the electric plug lock, according to an embodiment.

FIG. 2C shows the male connector 102 of the electric plug lock 100 connected to the female connector 104 of the electric plug lock 100, according to an embodiment. Some of the features in FIG. 2C are the same or similar to some of the features in FIGS. 1A-1D and 2A-2B as noted by the same reference numbers, unless expressly described otherwise.

As discussed above, the head 248 of the first power cord 246 may be inserted into the head 254 of the second power cord 252 to convey power from a power outlet to an electronic device. To lock the head 248 to the head 254 and avoid unintentional detachment, the male connector 102 may be inserted into the female connector 104. When the male connector 102 is connected to the female connector 104, the male connector 102 and the female connector 104 may have a locked connection to keep the head 248 and the head 254 securely connected together. In one example, when the cord 250 of the first power cord 246 and/or the cord 256 of the second power cord 252 are unintentionally pulled on, such as when an individual trips on the cord 250 or the cord 256, the male connector 102 and the female connector 104 of the electric plug lock 100 may keep the first power cord 246 from separating from the second power cord 252. In another example, when the cord 250 of the first power cord 246 and/or the cord 256 of the second power cord 252 are moved, the male connector 102 and the female connector 104 of the electric plug lock 100 may keep the first power cord 246 from separating from the second power cord 252.

Figure 3:
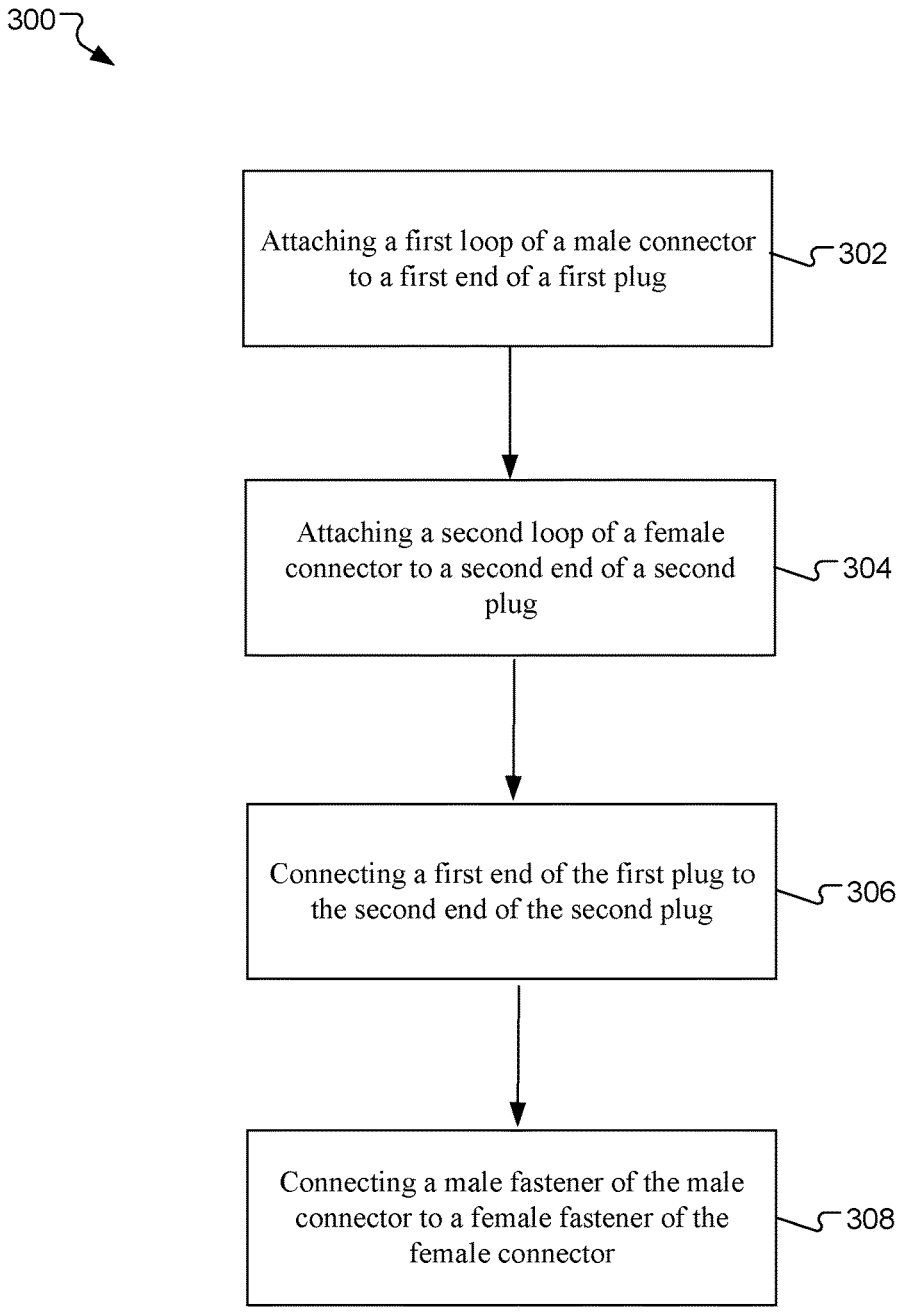
FIG. 3 shows a flowchart for a method of connecting a male connector to a female connector, according to an embodiment.

FIG. 3 shows a flowchart 300 for a method of connecting a male connector to a female connector, according to an embodiment. The method may include attaching a first loop of a male connector to a first end of a first plug (block 302). Attaching the first loop to the first end of the first plug further may include expanding a first opening of the first loop to fit over the first end, such as a head, of the first plug. The method may include attaching a second loop of a female connector to a second end of a second plug (block 304). Attaching the second loop to the second end of the second plug further may include expanding a second opening of the second loop to fit over the second end, such as a head, of the second plug.

The method may include connecting a first end of the first plug to the second end of the second plug (block 306). The method may include connecting a male fastener of the male connector to a female fastener of the female connector (block 308). When the male fastener of the male connector is connected to the female fastener of the female connector, the first end of the first plug is secured to the second end of the second plug.

The disclosure above encompasses multiple distinct embodiments with independent utility. While these embodiments has been disclosed in a particular form, the specific embodiments disclosed and illustrated above are not to be considered in a limiting sense as numerous variations are possible. The subject matter of the embodiments includes the novel and non-obvious combinations and sub-combinations of the various elements, features, functions and/or properties disclosed above and inherent to those skilled in the art pertaining to such embodiments. Where the disclosure or subsequently filed claims recite "a" element, "a first" element, or any such equivalent term, the disclosure or claims is to be understood to incorporate one or more such elements, neither requiring nor excluding two or more such elements.

Applicant(s) reserves the right to submit claims directed to combinations and sub-combinations of the disclosed embodiments that are believed to be novel and non-obvious. Embodiments embodied in other combinations and sub-combinations of features, functions, elements and/or properties may be claimed through amendment of those claims or presentation of new claims in the present application or in a related application. Such amended or new claims, whether they are directed to the same embodiment or a different embodiment and whether they are different, broader, narrower or equal in scope to the original claims, are to be considered within the subject matter of the embodiments described herein.

The invention claimed is:

1. A device, comprising:

a male connector comprising:

a first loop portion with a first opening operable to expand to fit over a first head of a first power cord;

a first neck with a proximal end connected to the first loop portion and a distal end connected to a male fastener, wherein the first loop portion and the first neck are elastic material; and the male fastener; and a female connector comprising:

a second loop portion with a second opening operable to expand to fit over a second head of a second power cord;

a second neck with a proximal end connected to the second loop portion and a distal end connected to a female fastener, wherein the second loop portion and the second neck are the elastic material; and the female fastener, wherein the female fastener is configured to connect to the male fastener of the male connector.

2. The device of claim 1, wherein:

the first head is a male end of the first power cord comprising a prong to conduct power; and the second head is a female end of the second power cord comprising an opening to receive the prong.

3. The device of claim 2, wherein the male connector is attachable to the female connector to secure the first head of the first power cord to the second head of the second power cord.

4. The device of claim 1, wherein:

the male fastener is a male portion of a buckle, a clip, a clasp, a belt connector, a hook, or a harness; and the female fastener is a female portion of the buckle, the clip, the clasp, the belt connector, the hook, or the harness.

5. The device of claim 1, wherein the male connector is an insulating material that does not conduct electricity and the female connector is the insulating material that does not conduct electricity.

6. The device of claim 1, wherein the male fastener includes a prong that is configured to connect to an opening or aperture of the female fastener.

7. The device of claim 1, wherein:

the male connector includes indicia to indicate the male connector is to connect to the first head; and the female connector includes indicia to indicate the female connector is to connect to the second head.

8. The device of claim 1, wherein the male connector is interchangeable with the female connector such that the male connector fits over the second head of the second power cord and the female connector fits over the first head of the first power cord.

9. A system, comprising:

a first power cord with a male head, the male head comprising a prong to conduct power;

a second power cord with a female head, the female head comprising an opening to receive the prong;

a male connector comprising:

a first loop portion with a first opening operable to expand to fit over the male head, wherein the first loop portion is an elastic material that is stretchable to increase a first diameter of the first opening to be greater than an outer perimeter of the male head when attached to the male head and decrease in the first diameter to be less than the outer perimeter of the male head once the male connector is attached to the male head; and a male fastener connected to the first loop portion; and a female connector comprising:

a second loop portion with a second opening operable to expand to fit over the female head, wherein the second loop portion is the elastic material that is stretchable to increase a second diameter of the second opening to be greater than an outer perimeter of the female head when attached to the female head and decrease in the second diameter to be less than the outer perimeter of the female head once the female connector is attached to the female head; and a female fastener connected to the second loop portion, wherein the female fastener is configured to connect to the male fastener.

10. The system of claim 9, wherein the first power cord extends from an electronic device and the second power cord extends from a power outlet.

11. The system of claim 9, wherein the male connector is attachable to the female connector to secure the male head to the female head.

12. The system of claim 9, wherein:

the male fastener is a male portion of a buckle, a clip, a clasp, a belt connector, or a harness; and the female fastener is a female portion of the buckle, the clip, the clasp, the belt connector, or the harness.

13. A method, comprising:

attaching a first loop of a male connector to a first end of a first plug, wherein the first loop is an elastic material configured to stretch over the first end of the first plug;

attaching a second loop of a female connector to a second end of a second plug, wherein the second loop is the elastic material configured to stretch over the second end of the second plug;

connecting the first end of the first plug to the second end of the second plug; and connecting a male fastener of the male connector to a female fastener of the female connector.

14. The method of claim 13, wherein when the male fastener of the male connector is connected to the female fastener of the female connector, the first end of the first plug is secured to the second end of the second plug.

15. The method of claim 13, wherein:

attaching the first loop to the first end of the first plug further comprises expanding a first opening of the first loop to fit over the first end of the first plug; and attaching the second loop to the second end of the second plug further comprises expanding a second opening of the second loop to fit over the second end of the second plug.

16. The method of claim 13, wherein the first end of the first plug is a male end of the first plug comprising a prong to conduct power; and the second end of the second plug is a female end of the second plug comprising an opening to receive the prong.

17. The method of claim 13, wherein the male fastener is a male portion of a buckle, a clip, a clasp, a belt connector, a hook, or a harness; and the female fastener is a female portion of the buckle, the clip, the clasp, the belt connector, the hook, or the harness.

* * * * *